US007949143B2

(12) United States Patent
Sekino et al.

(10) Patent No.: US 7,949,143 B2
(45) Date of Patent: May 24, 2011

(54) ULTRASONIC TRANSDUCER, ULTRASONIC SPEAKER, ACOUSTIC SYSTEM, AND CONTROL METHOD OF ULTRASONIC TRANSDUCER

(75) Inventors: Hirokazu Sekino, Chino (JP); Kinya Matsuzawa, Shiojiri (JP)

(73) Assignee: Seiko Epson Corporation (JP)

( * ) Notice: Subject to any disclaimer, the term of this patent is extended or adjusted under 35 U.S.C. 154(b) by 55 days.

(21) Appl. No.: 12/428,533

(22) Filed: Apr. 23, 2009

(65) Prior Publication Data

US 2009/0202088 A1 Aug. 13, 2009

Related U.S. Application Data

(63) Continuation of application No. 11/228,008, filed on Sep. 15, 2005, now Pat. No. 7,542,579.

(30) Foreign Application Priority Data

Sep. 16, 2004 (JP) ..... 2004-269290

(51) Int. Cl.
*H04R 25/00* (2006.01)

(52) U.S. Cl. ..... 381/191; 381/160; 367/181

(58) Field of Classification Search ..... 381/160, 381/191; 367/181
See application file for complete search history.

(56) References Cited

U.S. PATENT DOCUMENTS

| | | | | |
|---|---|---|---|---|
| 3,555,311 | A * | 1/1971 | Weber | 310/322 |
| 3,894,199 | A * | 7/1975 | Tamura et al. | 381/116 |
| 4,190,739 | A * | 2/1980 | Torffield | |
| 4,836,328 | A * | 6/1989 | Ferralli | |
| 4,907,671 | A * | 3/1990 | Wiley | |
| 5,327,985 | A * | 7/1994 | Porzilli | |
| 5,713,916 | A * | 2/1998 | Dias | |
| 6,257,365 | B1 * | 7/2001 | Hulsebus, II | |
| 6,760,455 | B2 * | 7/2004 | Croft et al. | |
| 6,775,388 | B1 * | 8/2004 | Pompei | 381/191 |
| 7,146,016 | B2 * | 12/2006 | Pedersen | |

FOREIGN PATENT DOCUMENTS

| | | | |
|---|---|---|---|
| JP | 04-351099 | | 12/1992 |
| JP | 2786531 | * | 5/1998 |
| JP | 10-234100 | | 9/1998 |
| WO | WO2003/032678 | * | 4/2003 |

OTHER PUBLICATIONS

Kelczynski, pawel Jan; "Ring Piezoelectric Transducers Radiating Ultrasonic Energy into the Air"; Jan. 1990; IEEE Transactions on Ultrasonics, Ferroelectrics, and Frequency Control; vol. 37, No. 1; pp. 38-42.*

* cited by examiner

*Primary Examiner* — Curtis Kuntz
*Assistant Examiner* — Ryan Robinson
(74) *Attorney, Agent, or Firm* — Harness, Dickey & Pierce, PLC

(57) ABSTRACT

An ultrasonic speaker or acoustic system includes an electrostatic type ultrasonic transducer of a push-pull system is constructed such that a through hole is arranged in the central portion of a fixing electrode of a circular shape. A sound wave reflecting plate is arranged on the rear face of the ultrasonic transducer and an ultrasonic wave radiated from the rear face of the ultrasonic transducer is reflected by the sound wave reflecting plate and is radiated to the front face of the ultrasonic transducer through the through hole.

4 Claims, 12 Drawing Sheets

FRONT VIEW

SECTIONAL VIEW

ULTRASONIC TRANSDUCER, ULTRASONIC SPEAKER, ACOUSTIC SYSTEM, AND CONTROL METHOD OF ULTRASONIC TRANSDUCER

CROSS-REFERENCE TO RELATED APPLICATIONS

This application is a continuation of U.S. patent application Ser. No. 11/228,008 filed on Sep. 15, 2005. This application claims the benefit of Japanese Patent Application No. 2004-269290 filed Sep. 16, 2004. The disclosures of the above applications are incorporated herein by reference.

FIELD OF THE INVENTION

The present invention relates to an ultrasonic transducer, an ultrasonic speaker, an acoustic system, and a control method of the ultrasonic transducer using an electrostatic type ultrasonic transducer of a push-pull system and able to forwards radiate an ultrasonic wave radiated from its rear face by a sound wave reflecting plate. The present invention particularly relates to an ultrasonic transducer, an ultrasonic speaker, an acoustic system, and a control method of the ultrasonic transducer able to greatly improve sound pressure with respect to an arranging area.

BACKGROUND OF THE INVENTION

In recent years, a speaker that has a parametric effect that utilizes nonlinearity of the air with respect to an ultrasonic wave, and combines a reflecting plate for reflecting a hearable sound wave by the reflecting plate with the speaker has been developed. See e.g., Japanese Patent No. 2,786,531.

In JP 2,786,531 an ultrasonic transducer array is constructed on a concave face of a parabolic substrate having an opening hole in a central portion. The reflecting plate of the hearable sound wave is arranged near the central point of a curvature radius of this substrate. Thus, a secondary wave (hearable sound wave) strong in directivity is reflected on the reflecting plate, and is radiated through a hole opened at the center of the parabolic substrate so that a compact speaker is produced. However, this relates to the ultrasonic transducer having a single sound wave output face. The electrostatic type ultrasonic transducer of the push-pull system having a structure for outputting the sound wave in both face directions of the ultrasonic transducer mainly uses a method in which the sound wave radiated to the rear side is radiated (leaked) as it is, and is attenuated by an absorption material, etc. and is disused. Accordingly, no sound wave emitted to the rear side can be effectively utilized.

FIG. 10 is an explanatory view of a driving concept of the electrostatic type ultrasonic transducer of the push-pull system. In the electrostatic type ultrasonic transducer of the push-pull system, a pair of opposite electrode portions 32*a* and 32*b* are arranged to be opposed to a vibrating film 31. A DC bias of the +side is applied to the vibrating film 31 by a DC bias power source, and an alternating current signal is applied between the opposite electrode portions 32*a* and 32*b*.

FIG. 10(*a*) is a view showing an amplitude state of the vibrating film 31 when the alternating current signal is zero (0) in voltage. The vibrating film 31 is located in a neutral position (the middle of the opposite electrode portions 32*a* and 32*b*). FIG. 10(*b*) is a view showing the amplitude state of the vibrating film 31 when a positive (+) voltage of the alternating current signal is applied to the opposite electrode portion 32*a*, and a negative (−) voltage of the alternating current signal is applied to the opposite electrode portion 32*b*. The central portion of the vibrating film 31 is attracted in the direction of the opposite electrode portion 32*b* by electrostatic force (attractive force) between the vibrating film 31 and the opposite electrode portion 32*b*, and electrostatic force (repulsive force) between the vibrating film 31 and the opposite electrode portion 32*a*.

FIG. 10(*c*) is a view showing the amplitude state of the vibrating film 31 when a negative (−) voltage of the alternating current signal is applied to the opposite electrode portion 32*a*, and a positive (+) voltage of the alternating current signal is applied to the opposite electrode portion 32*b*. The central portion of the vibrating film 31 is attracted in the direction of the opposite electrode portion 32*a* by the electrostatic force (attractive force) between the vibrating film 31 and the opposite electrode portion 32*a*, and the electrostatic force (repulsive force) between the vibrating film 31 and the opposite electrode portion 32*b*. Thus, the vibrating film 31 is vibrated in accordance with the alternating current signal and generates a sound wave. The sound wave generated from the vibrating film 31 is radiated in both the face directions of the opposite electrode portions 32*a* and 32*b*.

FIG. 11 depicts a working example of the conventional electrostatic type ultrasonic transducer of the push-pull system. When the electrostatic type ultrasonic transducer of the push-pull system (hereinafter also simply called the "ultrasonic transducer") of the structure for outputting the sound wave in both the face directions is used, the sound wave outputted from both the face sides of the fixing electrode 32 is emitted (leaked) as it is as shown in FIG. 11(*a*). Otherwise, as shown in FIG. 11(*b*), the sound wave outputted from the side of one opposite electrode portion 32*b* is attenuated by an absorption body 70, etc. Accordingly, no ultrasonic transducer is constructed so as to perfectly use the entire sound wave outputted from the ultrasonic transducer.

With respect to the problem discussed above in JP 2,786,531 that the construction is not suitable for perfectly using the entire sound wave outputted from the electrostatic type ultrasonic transducer of the push-pull system, a method for reflecting the sound wave radiated on the rear face of the electrostatic type ultrasonic transducer of the push-pull system and forwards radiating the sound wave by arranging a sound wave reflecting plate on this rear face has been proposed.

FIG. 12 is a view showing an example of the electrostatic type ultrasonic transducer of the push-pull system having the conventional sound wave reflecting plate, and in which the sound wave reflecting plate 42 is arranged on the rear face of the ultrasonic transducer 30. However, in this construction, when the outside diameter of the ultrasonic transducer is set to R2, it is necessary to set the outside diameter (R1) of the sound wave reflecting plate required here to twice or more the outside diameter R2 of the ultrasonic transducer. It is also necessary to set the area of the sound wave reflecting plate to four times or more the area of the ultrasonic transducer. Here, when $R1=2\cdot R2$ is set, the area of the sound wave radiating face of the ultrasonic transducer is "$(1/4)\cdot\pi\cdot(R1)^2$", and the area of the sound wave reflecting plate is "$\pi\cdot(R2)^2$".

Thus, the outside diameter of the ultrasonic speaker is determined by the outside diameter of the sound wave reflecting plate, and a region for generating an ultrasonic wave with respect to its size is ¼ in area and is therefore very narrow so that area efficiency is bad. Further, this large arranging space became a factor of difficulty of assembly into a video image or a television device, etc.

SUMMARY OF THE INVENTION

The present invention is made in light of the above problems, and a first object of the invention is to provide an ultrasonic transducer, an ultrasonic speaker, an acoustic system, and a control method of the ultrasonic transducer that is able to forward radiate the sound wave radiated from the rear face of the transducer by the reflecting plate in the electrostatic type ultrasonic transducer of the push-pull system, and greatly improve the sound pressure with respect to the arranging area of the ultrasonic speaker in comparison to a case that uses a conventional sound wave reflecting plate.

A second object of the present invention is to provide an ultrasonic transducer, an ultrasonic speaker and an acoustic system that is able to radiate the sound wave radiated from the rear face of the ultrasonic transducer onto the front face of the ultrasonic transducer in the electrostatic type ultrasonic transducer of the push-pull system using a fixing electrode having a square shape, and that is able to be compactly constructed to integrate two ultrasonic transducers and the sound wave reflecting plate, and able to realize a flat sound pressure distribution in a wide range.

In this regard, the present invention provides an electrostatic type ultrasonic transducer of a push-pull system constructed such that a through hole is arranged in the central portion of a fixing electrode of a circular shape. A sound wave reflecting plate is arranged on the rear face of the ultrasonic transducer and an ultrasonic wave radiated from the rear face of the ultrasonic transducer is reflected by the sound wave reflecting plate and is radiated to the front face of the ultrasonic transducer through the through hole.

In accordance with such a construction, the sound wave radiated from the rear face of the ultrasonic transducer is collected in the central portion of the ultrasonic transducer by the sound wave reflecting plate, and is radiated toward the front face from the through hole arranged in the central portion of the ultrasonic transducer.

Thus, the sound wave radiated from the rear face of the electrostatic type ultrasonic transducer can be radiated forward by the sound wave reflecting plate, and the area efficiency of a generating area of the ultrasonic wave can be raised in comparison to a case that uses a conventional sound wave reflecting plate (a sound pressure ratio with respect to an arranging area of the ultrasonic speaker can be raised).

In accordance with a second embodiment of the present invention, an outside diameter of the through hole is set to ½ or more of the outside diameter of the fixing electrode. In this manner, when the fixing electrode is set to a circular shape, the through hole of ½ or more of the outside diameter is arranged in the central portion of the fixing electrode, and the sound wave radiated from the rear face of the ultrasonic transducer is reflected by the sound wave reflecting plate and is radiated to the front face through this through hole. Thus, the entire sound wave (or the greater part) radiated from the rear face of the ultrasonic transducer can be radiated to the front face of the ultrasonic transducer. Therefore, an output sound pressure of the ultrasonic transducer can be raised.

In accordance with a third embodiment of the present invention, the ultrasonic transducer comprises a moving mechanism for moving the position of the sound wave reflecting plate forward and backward along a sound wave radiating direction of the ultrasonic transducer and the ultrasonic transducer also comprises moving mechanism control means for controlling the operation of the moving mechanism to adjust the moving amount of the sound wave reflecting plate from the rear face of the ultrasonic transducer in accordance with the frequency of an ultrasonic carrier wave signal for operating the ultrasonic transducer.

In accordance with such a construction, the positions of the ultrasonic transducer and the sound wave reflecting plate are adjusted by the moving mechanism control means. The moving mechanism control means also removes the phase difference between the ultrasonic wave (ultrasonic carrier wave signal) directly radiated from the ultrasonic transducer toward the front face and the ultrasonic wave (ultrasonic carrier wave signal) radiated from the rear face of the ultrasonic transducer and reflected on the sound wave reflecting plate and radiated to the front face.

Thus, any cancellation due to overlapping of the waves of reverse phases of the ultrasonic wave radiated forward from the ultrasonic transducer and the ultrasonic wave radiated forward by the action of the sound wave reflecting plate is restrained. Further, a reduction of the output sound pressure of the ultrasonic transducer can also be restrained.

In accordance with a fourth embodiment of the present invention, the moving mechanism control means adjusts the moving amount of the sound wave reflecting plate through the moving mechanism such that the difference in carrier path length between the ultrasonic wave directly radiated from the front face of the ultrasonic transducer and the ultrasonic wave radiated from the rear face of the ultrasonic transducer and reflected on the sound wave reflecting plate becomes $n \cdot \lambda + \lambda/2$ (n is an integer) when the wavelength of the ultrasonic carrier wave signal is set to $\lambda$.

In accordance with such a construction, the moving mechanism control means adjusts the phase difference between the ultrasonic wave directly radiated from the ultrasonic transducer toward the front face and the ultrasonic wave radiated from the rear face of the ultrasonic transducer and reflected on the sound wave reflecting plate and radiated to the front face so as to become "$n \cdot \lambda + \lambda/2$ (n is an integer)".

Thus, any cancellation due to overlapping of the waves of reverse phases of the ultrasonic wave radiated forward from the ultrasonic transducer and the ultrasonic wave radiated forward by the action of the sound wave reflecting plate is restrained, A reduction of the output sound pressure of the ultrasonic transducer can also be restrained.

In accordance with a fifth embodiment of the present invention, the sound wave reflecting plate is arranged on the rear face of the ultrasonic transducer. The sound wave reflecting plate has a first reflecting face for reflecting the sound wave radiated from the rear face of the ultrasonic transducer in a direction parallel to the sound wave radiating face of the ultrasonic transducer and the central direction of the ultrasonic transducer. A second reflecting face for reflecting the sound wave radiated from the first reflecting face in the direction of the sound wave radiating face of the ultrasonic transducer is also provided.

In accordance with such a construction, the ultrasonic wave radiated from the rear face of the ultrasonic transducer is perpendicularly reflected on the first reflecting face and is directed in the direction parallel to the sound wave radiating face. The ultrasonic wave is further perpendicularly reflected on the second reflecting face, and is directed in the direction of the sound wave radiating face of the ultrasonic transducer. Thus, the ultrasonic wave radiated from the rear face of the ultrasonic transducer can be directed in the direction of the front face of the ultrasonic transducer by simply using the two reflecting faces.

In accordance with a sixth embodiment of the present invention, the sound wave reflecting plate is constructed in a middle folding shape in which the top of a hollow conical body that has a bottom face portion that has a diameter equal to the diameter of the ultrasonic transducer or more and a height of about ½ of the diameter of the bottom face is pushed down until the vicinity of the central bottom face is along a central axis. It is also constructed in a shape in which the bottom face portion is opened.

The opened bottom face portion of the sound wave reflecting plate is arranged to be opposed to the rear face of the ultrasonic transducer, and the inner face of a portion not folded in the middle of the sound wave reflecting plate is constructed as a first reflecting face. The inner face of the portion folded in the middle is constructed as a second reflecting face.

The sound wave reflecting plate is formed in a middle folding shape in which the top of a hollow conical body opened on the bottom face is pushed down until the vicinity of the central bottom face is along the central axis. Thus, the sound wave reflecting plate is formed in a simple shape and can be easily manufactured.

A seventh embodiment of the present invention is an ultrasonic speaker having the electrostatic type ultrasonic transducer of the push-pull system described above. The ultrasonic speaker is constructed by the ultrasonic transducer using the fixing electrode of the circular shape having the through hole and the sound wave reflecting plate.

Thus, in the ultrasonic speaker, the sound wave radiated from the rear face of the electrostatic type ultrasonic transducer of the push-pull system can be radiated forwards by the reflecting plate. Further, the ultrasonic speaker raising the area efficiency of an area for generating the ultrasonic wave (raising the output sound pressure ratio with respect to the arranging area of the ultrasonic speaker) can be constructed in comparison with the case using the conventional sound wave reflecting plate.

An eighth embodiment of the present invention is an acoustic system having the ultrasonic speaker constructed by the ultrasonic transducer using the fixing electrode of the circular shape having the through hole and the sound wave reflecting plate. The ultrasonic speaker constructed by the ultrasonic transducer using the fixing electrode of the circular shape having the through hole and the sound wave reflecting plate is used in the acoustic system. Thus, the ultrasonic speaker raising the output sound pressure ratio with respect to the arranging area can be assembled into the acoustic system in comparison with the conventional case, and becomes effective as a sound source device assembled into a video device, and a compact electronic device, such as a projector, etc.

A ninth embodiment of the present invention is an electrostatic type ultrasonic transducer of a push-pull system constructed such that two ultrasonic transducers each having a fixing electrode of a square shape are spaced from each other at a predetermined distance and are arranged in parallel so as to locate their sound wave radiating faces on the same face a sound wave reflecting plate is arranged on the rear faces of the two ultrasonic transducers. A sound wave radiated from the rear face of each of the ultrasonic transducers is reflected by the sound wave reflecting plate, and is radiated to the front face through a vacant space between the two ultrasonic transducers.

In accordance with such a construction, the two ultrasonic transducers each having the fixing electrode of the square shape are arranged by arranging a vacant space for passing the sound wave therebetween. The sound wave reflecting plate is arranged on the rear faces of the two ultrasonic transducers and their vacant space. The sound wave radiated from the rear face of each ultrasonic transducer is reflected by the sound wave reflecting plate, and is radiated toward the front face direction of the ultrasonic transducer through the vacant space between the two ultrasonic transducers.

Thus, in the ultrasonic transducer using the fixing electrode of the square shape, the sound wave radiated from the rear face of the ultrasonic transducer is also radiated to the front face of the ultrasonic transducer, and the sound wave radiated from the rear face of the ultrasonic transducer can be effectively utilized. Further, the two ultrasonic transducers and the sound wave reflecting plate can be integrated and compactly constructed. For example, when this ultrasonic transducer is mounted to a television system, etc., the sound wave can be radiated from a comparatively wide area of the front face, and the ultrasonic speaker for realizing a flat sound pressure distribution in a wide range can be provided.

In accordance with a tenth embodiment of the present invention, the sound wave reflecting plate is formed by bending a flat plate in a triangular wave shape at an angle of about 90 degrees in parallel with one side so as to have first to fourth slanting flat planes having an equal shape. The sound wave radiated from the rear face of one ultrasonic transducer is reflected by the first slanting plane in a direction parallel to the sound wave radiating face of the ultrasonic transducer and the direction of the vacant space of the two ultrasonic transducers the sound wave radiated from the first reflecting face is reflected toward the direction of the sound wave radiating face of the ultrasonic transducer by the second slanting plane.

The sound wave radiated from the rear face of the other ultrasonic transducer is reflected by the fourth slanting plane in a direction parallel to the sound wave radiating face of the ultrasonic transducer and the direction of the vacant space of the two ultrasonic transducers. The sound wave radiated from the fourth reflecting face is reflected toward the direction of the sound wave radiating face of the ultrasonic transducer by the third slanting plane.

In accordance with such a construction, the four slanting planes are arranged by bending the sound wave reflecting plate at an angle of 90 degrees in a triangular wave shape. The sound wave radiated from the rear face of one ultrasonic transducer is reflected on the first and second slanting planes, and is radiated toward the front face direction of the ultrasonic transducer. Further, the sound wave radiated from the rear face of the other ultrasonic transducer is reflected on the third and fourth slanting planes, and is radiated toward the front face direction of the ultrasonic transducer. Thus, the sound wave reflecting plate is simply constructed and can be easily manufactured.

An eleventh embodiment of the present invention is the ultrasonic transducer has a moving mechanism for moving the position of the sound wave reflecting plate forward and backward along the sound wave radiating direction of the ultrasonic transducer, and moving mechanism control means for controlling the operation of the moving mechanism to adjust the moving amount of the sound wave reflecting plate from the rear face of the ultrasonic transducer in accordance with the frequency of an ultrasonic carrier wave signal for operating the ultrasonic transducer.

In accordance with such a construction, the positions of the ultrasonic transducer and the sound wave reflecting plate are adjusted by the moving mechanism control means. The moving mechanism control means also removes the phase difference between the ultrasonic wave (ultrasonic carrier wave signal) directly radiated from the ultrasonic transducer to the front face and the ultrasonic wave (ultrasonic carrier wave signal) radiated from the rear face of the ultrasonic transducer and reflected on the sound wave reflecting plate and radiated to the front face. Thus, cancellation due to overlapping of the waves of reverse phases of the ultrasonic wave radiated forwards from the ultrasonic transducer and the ultrasonic wave radiated forwards by the action of the sound wave reflecting plate is restrained. Thus, it is possible to restrain that the output sound pressure of the ultrasonic transducer is reduced.

A twelfth embodiment of the present invention is an ultrasonic speaker having the electrostatic type ultrasonic transducer of the push-pull system having the fixing electrode of the square shape mentioned above.

The ultrasonic speaker is constructed by the two ultrasonic transducers (arranged by forming a space for passing the sound wave) each having the fixing electrode of the square shape and the sound wave reflecting plate by such a construction. Thus, it is possible to construct a compact ultrasonic speaker by integrating the two ultrasonic transducers and the sound wave reflecting plate. For example, when this ultrasonic speaker is mounted to a television system, etc., the sound wave can be radiated from a comparatively wide area of the front face. Thus, it is possible to provide the ultrasonic speaker for realizing a flat sound pressure distribution in a wide range.

A thirteenth embodiment of the present invention is an acoustic system having the ultrasonic speaker using the ultrasonic transducer having the fixing electrode of the above square shape.

The ultrasonic speaker constructed by the two ultrasonic transducers (arranged by forming a space for passing the sound wave) having the fixing electrode of the square shape and the sound wave reflecting plate is assembled into the acoustic system by such a construction.

Thus, the ultrasonic speaker of a compact construction formed by integrating the two ultrasonic transducers and the sound wave reflecting plate can be assembled as the acoustic system. Further, for example, in the television system, etc., the sound wave can be radiated from a comparatively wide area of the front face. Thus, it is possible to provide the acoustic system mounting the ultrasonic speaker for realizing a flat sound pressure distribution in a wide range.

A fourteenth embodiment of the present invention is a control method of an electrostatic type ultrasonic transducer of a push-pull system including a procedure for arranging a through hole in the central portion of a fixing electrode of a circular shape, a procedure for arranging a sound wave reflecting plate on the rear face of the ultrasonic transducer, and a procedure for reflecting an ultrasonic wave radiated from the rear face of the ultrasonic transducer by the sound wave reflecting plate, and radiating the ultrasonic wave to the front face of the ultrasonic transducer through the through hole.

The method also includes a procedure for arranging a moving mechanism for moving the position of the sound wave reflecting plate forward and backward along a sound wave radiating direction of the ultrasonic transducer, and a moving mechanism control procedure for controlling the operation of the moving mechanism so as to adjust the moving amount of the sound wave reflecting plate from the rear face of the ultrasonic transducer in accordance with the frequency of an ultrasonic carrier wave signal for operating the ultrasonic transducer.

In accordance with such a method, the sound wave radiated from the rear face of the ultrasonic transducer is collected in the central portion of the ultrasonic transducer by the sound wave reflecting plate, and is radiated from the through hole arranged in the central portion of the ultrasonic transducer to the front face. Further, the positions of the ultrasonic transducer and the sound wave reflecting plate are adjusted and the phase difference between the ultrasonic wave (ultrasonic carrier wave signal) directly radiated from the ultrasonic transducer to the front face and the ultrasonic wave (ultrasonic carrier wave signal) radiated from the rear face of the ultrasonic transducer and reflected on the sound wave reflecting plate and radiated to the front face is removed by the moving mechanism control procedure.

Thus, the sound wave radiated from the rear face of the electrostatic type ultrasonic transducer can be radiated forwards by the reflecting plate. Further, the area efficiency of a generating area of the ultrasonic wave can be raised (the sound pressure ratio with respect to the arranging area of the ultrasonic speaker can be raised) in comparison with the case using the conventional sound wave reflecting plate. Further, the generation of canceling due to overlapping of the waves of reverse phases of the sound wave radiated forwards from the ultrasonic transducer and the sound wave radiated forwards by the action of the sound wave reflecting plate is restrained. Thus, it is possible to restrain that the output sound pressure of the ultrasonic transducer is reduced.

In accordance with a fifteenth embodiment of the present invention, the moving amount of the sound wave reflecting plate is adjusted through the moving mechanism in the moving mechanism control procedure such that the difference in carrier path length between the ultrasonic wave directly radiated from the front face of the ultrasonic transducer and the ultrasonic wave radiated from the rear face of the ultrasonic transducer and reflected on the sound wave reflecting plate becomes $n \cdot \lambda + \lambda/2$ (n is an integer) when the wavelength of the ultrasonic carrier wave signal is set to $\lambda$.

In accordance with such a procedure, the phase difference between the ultrasonic wave (ultrasonic carrier wave signal) directly radiated from the ultrasonic transducer to the front face and the ultrasonic wave (ultrasonic carrier wave signal) radiated from the rear face of the ultrasonic transducer and reflected on the sound wave reflecting plate and radiated to the front face is adjusted so as to become "$n \cdot \lambda + \lambda/2$ (n is an integer)" by the moving mechanism control procedure.

Thus, the generation of canceling due to overlapping of the waves of reverse phases of the sound wave radiated forwards from the ultrasonic transducer and the sound wave radiated forwards by the action of the sound wave reflecting plate is restrained. Thus, it is possible to restrain that the output sound pressure of the ultrasonic transducer is reduced.

DETAILED DESCRIPTION OF THE PREFERRED EMBODIMENTS

The first and second embodiment will be explained as best modes for carrying out the present invention. It should be understood, however, that the present invention is not limited to each of the following embodiments. That is, for example, constructional elements of these embodiments may be suitably combined.

Figures 2A, 2B:
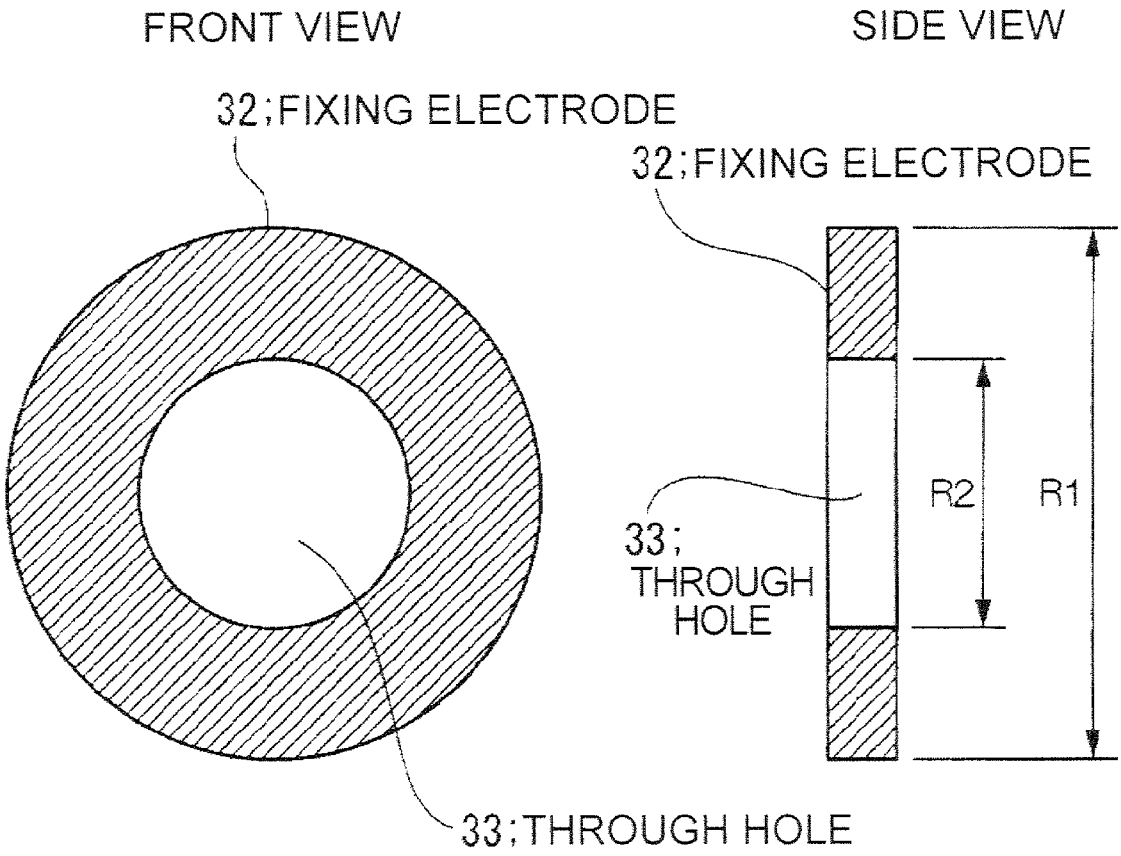
FIGS. 2A and 2B are views showing a constructional example of a fixing electrode of an ultrasonic transducer.

In the first embodiment, a through hole 33 is arranged at a center of a circular fixing electrode 32 constituting an electrostatic type ultrasonic transducer of the push-pull system (simply also called the "ultrasonic transducer") (see FIG. 2).

Figure 1:
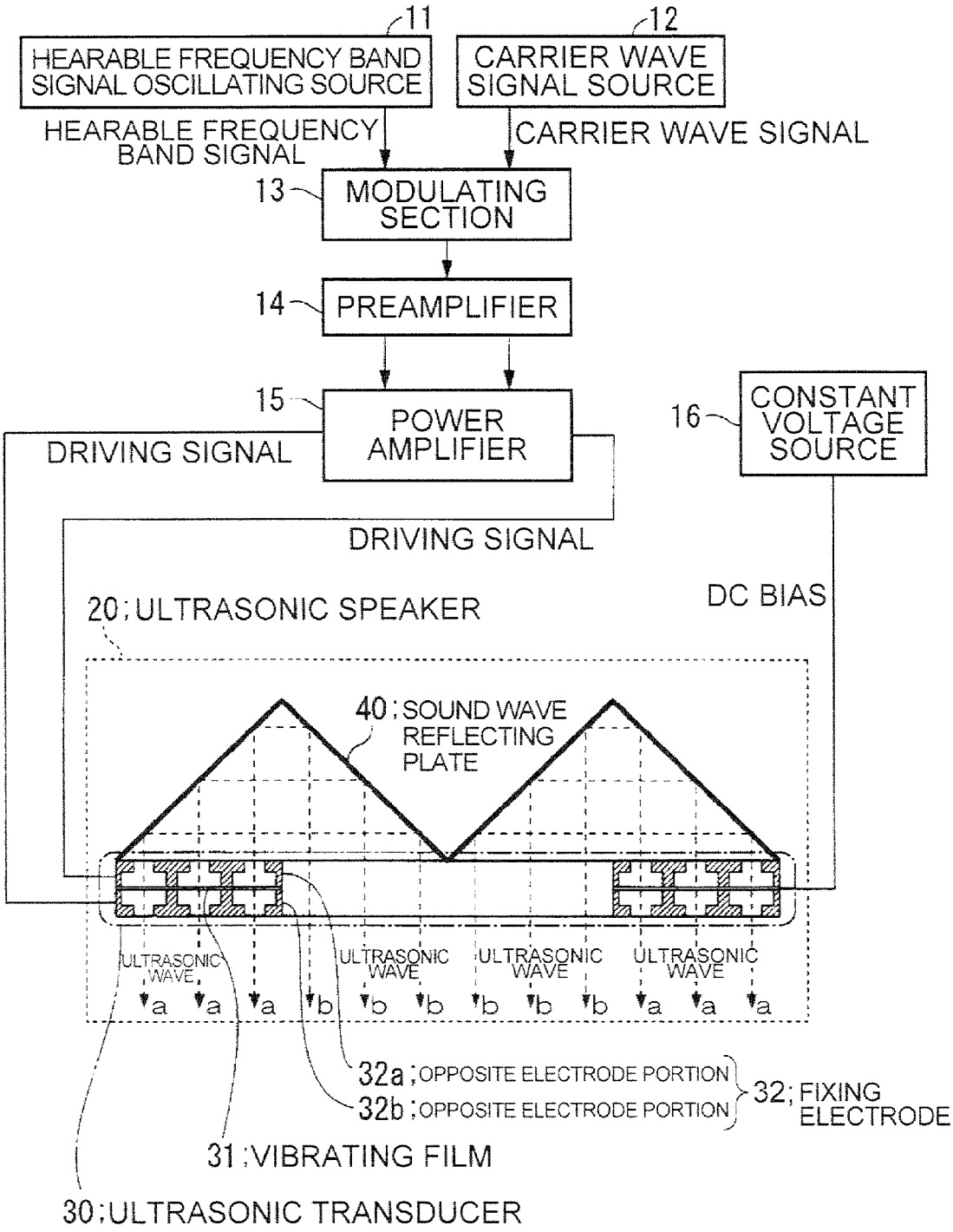
FIG. 1 is a view showing a first constructional example of an ultrasonic speaker of the present invention.

The outside diameter of this through hole 33 is set to ½ or more of the outside diameter of the fixing electrode 32 that constitutes the ultrasonic transducer. Further, a sound wave reflecting plate 40 is arranged on the rear face of the ultrasonic transducer 30 arranging the through hole 33 therein (FIG. 1). This sound wave reflecting plate 40 is set to a structure for collecting a sound wave radiated from the rear face of the ultrasonic transducer 30 in the central portion of the ultrasonic transducer 30, and radiating the sound wave to the front face of the ultrasonic transducer 30 through this through hole 33.

Further, a moving mechanism (slide mechanism) is arranged in the sound wave reflecting plate 40 so as to move the position of the sound wave reflecting plate 40 in the forward and backward directions with respect to the ultrasonic transducer 30 in conformity with the frequency of a carrier wave.

Figure 8:
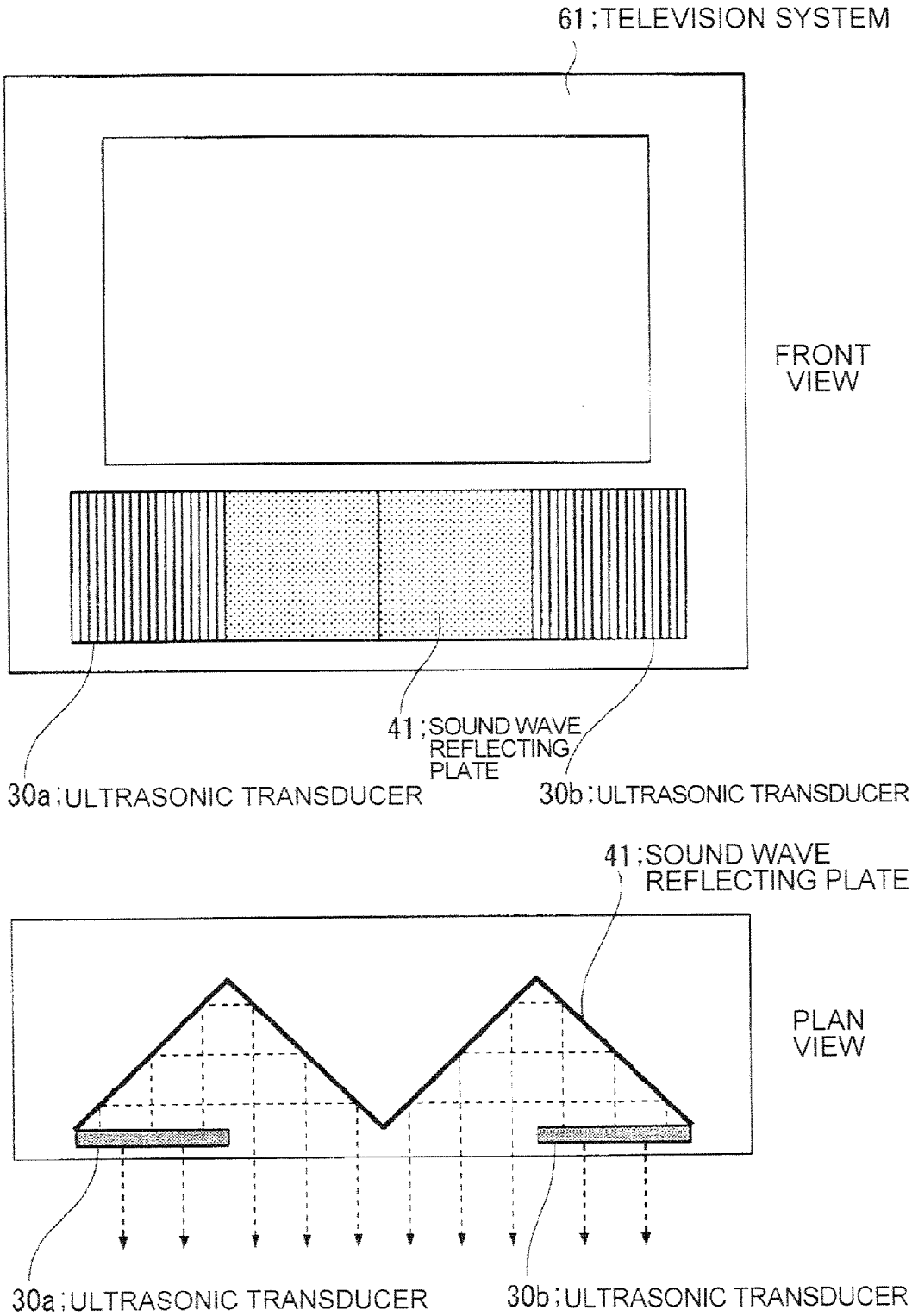
FIG. 8 is a view showing an application example of the ultrasonic transducer using the fixing electrode of the square shape.

The second embodiment of the present invention comprises two ultrasonic transducers 30*a* and 30*b* each having the fixing electrode of a square shape that are spaced (a vacant space is arranged) and arranged in parallel so as to locate respective sound wave radiating faces on the same face (see FIG. 8).

The sound wave reflecting plate is arranged on the rear faces of the two ultrasonic transducers. This sound wave reflecting plate is a structure for collecting the sound waves radiated from the rear face of each ultrasonic transducer in a central portion between the two ultrasonic transducers, and a structure for radiating the sound wave to the front face through the vacant space between the two ultrasonic transducers (see FIG. 8).

FIG. 1 is a view showing an example of the ultrasonic speaker of the present invention.

In FIG. 1, a modulating section 13 sets a signal of a hearable frequency band generated in a hearable frequency band signal emitting source 11 to an input signal, and performs signal processing for modulating a carrier wave signal (an ultrasonic carrier wave signal) generated in a carrier wave signal source by the hearable frequency signal, etc. A preamplifier 14 performs former stage amplification of a modulating signal and further amplifies the modulating signal by a power amplifier 15. An ultrasonic transducer 30 converts the modulating signal amplified by the power amplifier 15 into a sound wave (ultrasonic wave) and radiates the sound wave into the air. With respect to the radiated ultrasonic wave, a parametric effect is caused during air propagation, and the hearable frequency sound wave is self-demodulated, and can be heard as a hearable sound.

Here, the ultrasonic transducer 30 has a push-pull structure in which a vibrating film 31 formed of an electrically conductive material sandwiched by an insulator is nipped and supported by two fixing electrodes 32 (opposite electrode portions 32*a* and 32*b*).

A bias voltage is applied to the vibrating film 31 by a constant voltage power source 16, and an alternating current is applied to the two fixing electrodes 32 (opposite electrode portions 32*a* and 32*b*) to be alternately switched in polarity. Thus, an attractive action and a repulsive action are simultaneously taken in the vibrating film 31 so that the vibrating film 31 is vibrated.

As shown by arrow dot lines a and b in FIG. 1, sound waves are directly radiated forwards and sound waves b are radiated rearward. With respect to the sound wave b radiated to the rear face, however, a sound wave reflecting plate 40 is arranged on the rear face of the ultrasonic transducer 30. As such, the radiating direction of sound wave b is changed by the sound wave reflecting plate 40 such that sound wave b can be reflected forwards.

The ultrasonic speaker 20 of the present invention is composed of the ultrasonic transducer 30 and the sound wave reflecting plate 40. By this configuration, the sound wave radiated from the rear face of the ultrasonic transducer 30 is effectively utilized.

FIG. 2 is a view showing an example of the fixing electrode 32 of the ultrasonic transducer. As shown in FIG. 2, in the ultrasonic transducer 30 of the first embodiment, a through hole 33 having an outside diameter R2 is arranged in the fixing electrode 32 having an outside diameter R1 so that a doughnut shape is formed. Here, the outside diameter R2 of the through hole 33 is set to ½ or more of the outside diameter R1 of the fixing electrode 32. When R1=2×R2 is set, the area of a sound wave radiating face is "$(3/4)\times\pi\times(R1)^2$".

Figure 3:
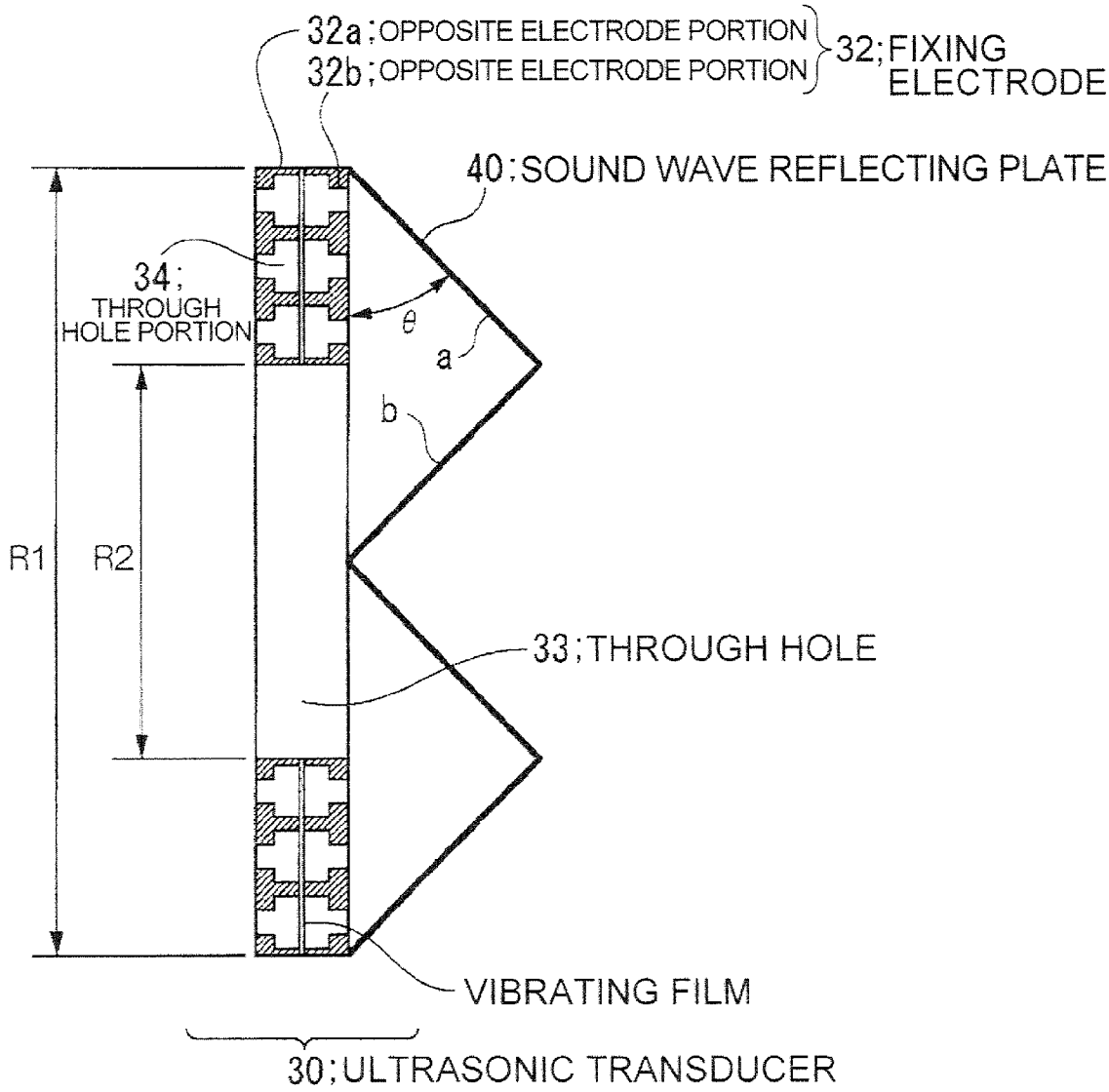
FIG. 3 is a view showing the details of a constructional example of the ultrasonic transducer and its reflecting plate.

FIG. 3 shows the details of an example of the ultrasonic transducer and its reflecting plate in the first embodiment.

In FIG. 3, the fixing electrode 32 is composed of opposite electrode portions 32*a* and 32*b*, and a through hole portion 34. The opposite electrode portions 32*a* and 32*b*, and the through hole portion 34, are arranged in the same shape and position, or about the same shape and position. The vibrating film 31 is held by a structure nipped by the opposite electrode portions 32*a* and 32*b*. A sound wave generated by vibrating the vibrating film 31 is radiated into the air through the through hole portion 34.

The sound wave reflecting plate 40 has a predetermined angle θ (preferably 45 degrees) with respect to the sound wave radiating face of the fixing electrode 32, and has a shape returned in an intermediate position of a cone (a shape in which the top of the cone is pushed down along the central axis and is folded in the middle) that is arranged on the rear face of the ultrasonic transducer 30 (the sound wave reflecting plate 40 is shown in two-dimensional section in FIG. 3).

The advancing direction of the sound wave is first changed to a direction parallel to the sound wave radiating face 40 on the outer circumferential side a of the sound wave reflecting plate 40. Thereafter, the sound wave is reflected on the inner circumferential side b of the sound wave reflecting plate and the advancing direction is changed to the forward direction.

Here, the size of the sound wave reflecting plate 40 has an outside diameter equal to that of the ultrasonic transducer 30. Accordingly, the area of the sound wave reflecting plate is $\pi(R1)^2$. Namely, even when the area of the sound wave reflecting plate 40 is the same as the conventional case, the area of the sound wave radiating face of the ultrasonic transducer can be set to three times the conventional area. Accordingly, area efficiency can be greatly improved.

On the other hand, the area may be set to ⅓ to obtain the sound pressure equal to that of the conventional case. Namely, the outside diameter can be reduced to $1/\sqrt{3}$. Accordingly, it can be said that a very effective construction in compactness can be also set.

When the sound wave is radiated in such a construction, the sound waves radiated from the front face and the rear face of the ultrasonic transducer 30 mutually have reverse phases. Therefore, cancellation due to overlapping of the waves of the reverse phases is generated in one portion near the boundary of the sound wave radiated directly forwards from the front face and the sound wave radiated from the rear face and radiated forwards by the action of the sound wave reflecting plate. Therefore, there is a possibility that the sound pressure is reduced.

In this case, a sound pressure distribution difference in an area reduced in the sound pressure and its circumferential area having no influence on this reduction becomes notable. However, the countermeasure shown in FIG. 4 may be taken to realize a flat sound pressure distribution over all the areas.

Figure 4:
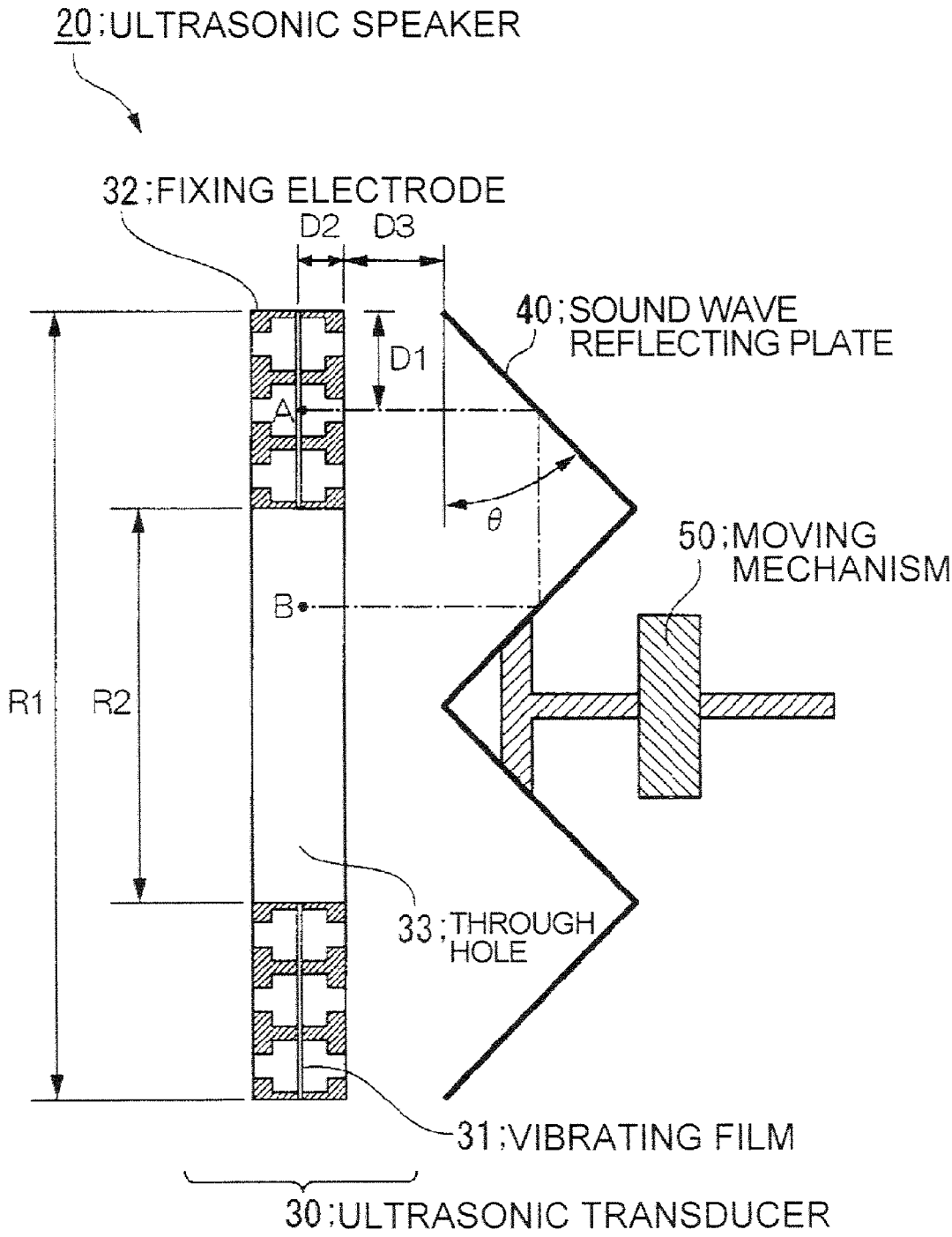
FIG. 4 is a view showing an example of the ultrasonic speaker having a moving mechanism of a sound wave reflecting plate.

FIG. 4 is a view showing an example of the ultrasonic speaker having a moving mechanism of the sound wave reflecting plate. In the example shown in FIG. 4, the moving mechanism (slide mechanism) 50 is able to move the sound wave reflecting plate 40 in the forward and backward directions of the sound wave radiating face with respect to the ultrasonic transducer 30. The moving mechanism 50 is arranged on the rear face of the sound wave reflecting plate 40. The moving mechanism 50 moves the sound wave reflecting plate 40 and adjusts a distance (moving amount) D3 in conformity with a carrier wave signal frequency (ultrasonic wave carrier signal frequency). Thus, the carrier lengths of the sound wave radiated directly forwards from the ultrasonic transducer and the sound wave radiated from the rear face and radiated forwards by the action of the sound wave reflecting plate 40 are shifted by a half wavelength of the carrier frequency. An electromagnetic actuator, a pantograph mechanism of an electrically operated type linearly operated, etc. are preferably used as the moving mechanism 50 used here.

Here, in the case of the moving distance D3=0, a difference of the distance between A and B already shown by one dotted chain line in FIG. 4 is caused with respect to the carrier lengths of the sound wave radiated from the front face of the ultrasonic transducer and the sound wave radiated from the rear face and radiated forwards by the sound wave reflecting plate. The positions of A and B are conformed to the position of the vibrating film.

When the outside diameter of the fixing electrode 32 is set to R1 and the outside diameter of the through hole 33 is set to R2 and the angle θ formed by the sound wave reflecting plate and the sound wave radiating face (=fixing electrode surface) of the ultrasonic transducer is set to 45 degrees and the distance from the outer circumference of the fixing electrode to a sound wave radiating position is set to D1 and the gap of the sound wave radiating face of the ultrasonic transducer and the vibrating film is set to D3, the distance between A and B becomes "R1−R2+2·D2" irrespective of the sound wave radiating position (D1). (The positions of the outer circumference of the through hole and the inside diameter of the sound wave reflecting plate are set to be conformed to each other.)

Accordingly, when the sound wave reflecting plate 40 is moved, its moving amount D3 is added to this movement so that the distance between A and B becomes "R1−R2+2D2+2·D3". This distance between A and B and the wavelength λ of the carrier frequency are compared. If the moving amount D3 is adjusted such that the distance between A and B becomes "n·λ+λ/2 (n is an integer)" with respect to the wavelength λ, the sound waves radiated from the front face and the rear face of the ultrasonic transducer can be conformed to the same phase.

Figure 5:
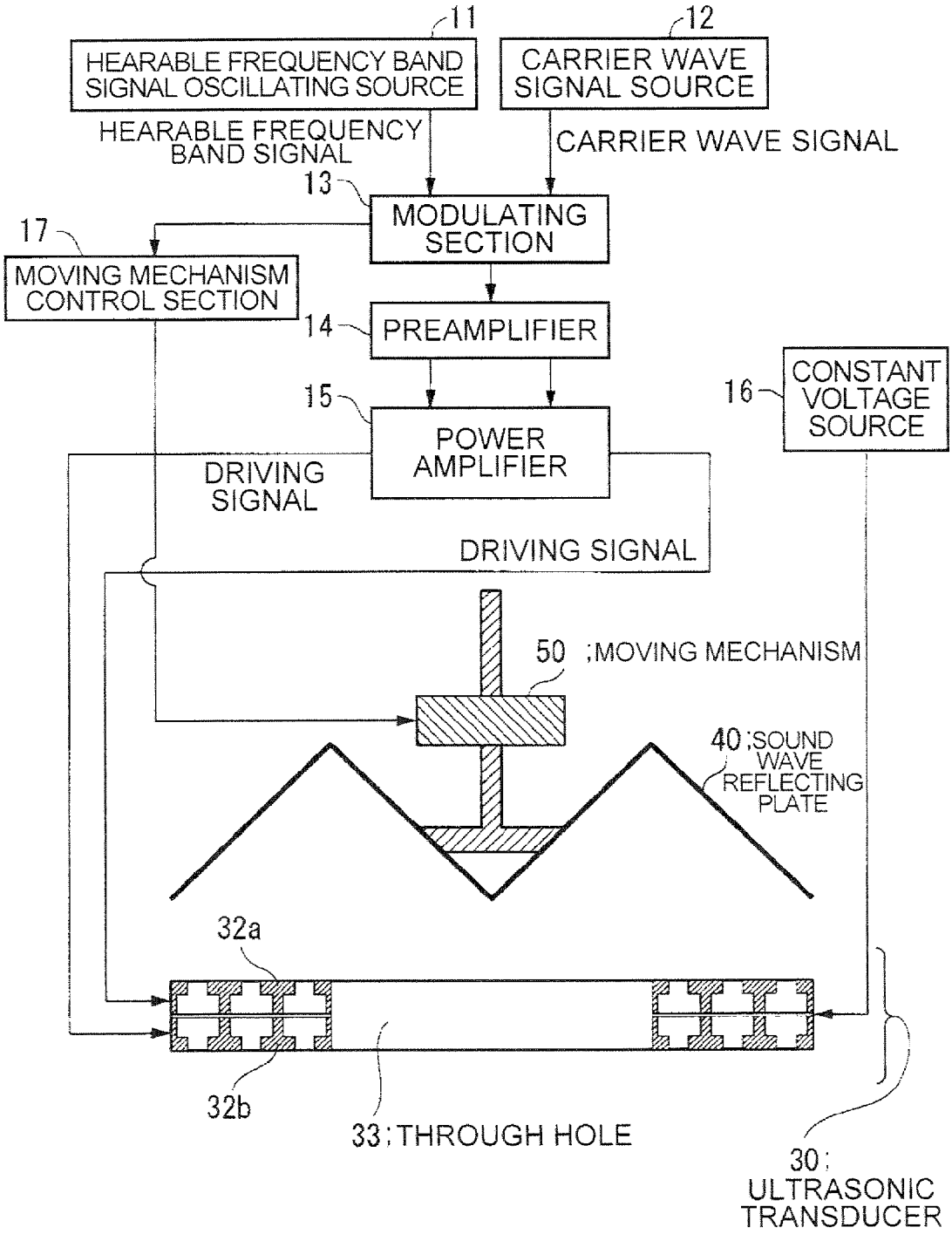
FIG. 5 is a view showing an example of a control circuit of the moving mechanism.

FIG. 5 shows an example of a control circuit of the moving mechanism. Since the frequency of the carrier wave is determined at the stage of modulation processing, its information signal is sent from the modulating section 13 to a moving mechanism control section 17. In the moving mechanism control section 17, a half wavelength amount according to the frequency is calculated from the signal. The carrier length (=the distance between A and B) of the rear face reflecting sound wave in a state (D3=0) for not moving the moving mechanism 50 is set to the moving mechanism control section 17 in advance, and the moving mechanism 50 is operated on the basis of the moving amount calculated in accordance with the information signal of the carrier frequency. When the used carrier frequency is determined in advance, the moving amount with respect to each carrier frequency is stored as data in advance, and these data may be referred at any time.

The sound waves radiated from the front face and the rear face can be conformed to the same phase by such a construction. Therefore, any cancellation of the sound waves due to the reverse phase near the boundary is removed so that an ultrasonic speaker more reliably holding a high sound pressure can be constructed.

The ultrasonic speaker using the ultrasonic transducer explained above is effective as a sound source device (acoustic system) assembled into a video device, a compact electronic device, etc. such as a projector, etc.

A second embodiment mode of the ultrasonic speaker of the present invention will next be explained.

As shown in FIG. 1, the fixing electrode constituting the ultrasonic transducer used in the first example is formed in a doughnut shape, i.e., a circular shape. However, in the construction using the reflecting plate in the electrostatic type ultrasonic transducer of the push-pull system, the fixing electrode of another shape can be also used.

Figure 6:
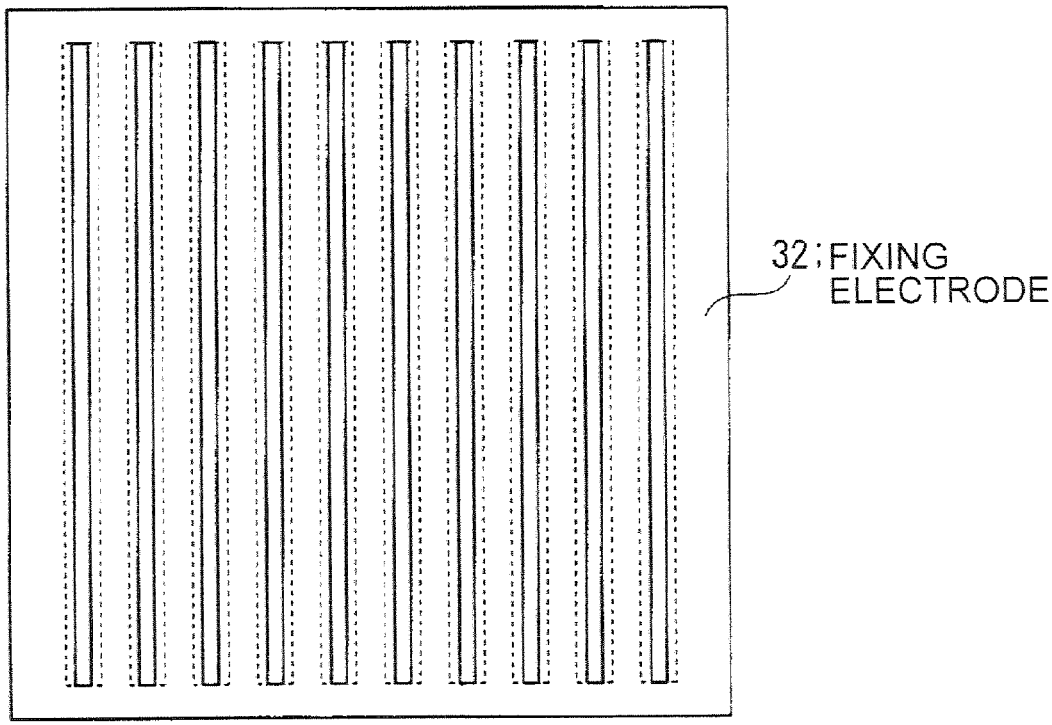
FIG. 6 is a view showing an example of the fixing electrode of a square shape.
Figure 6:
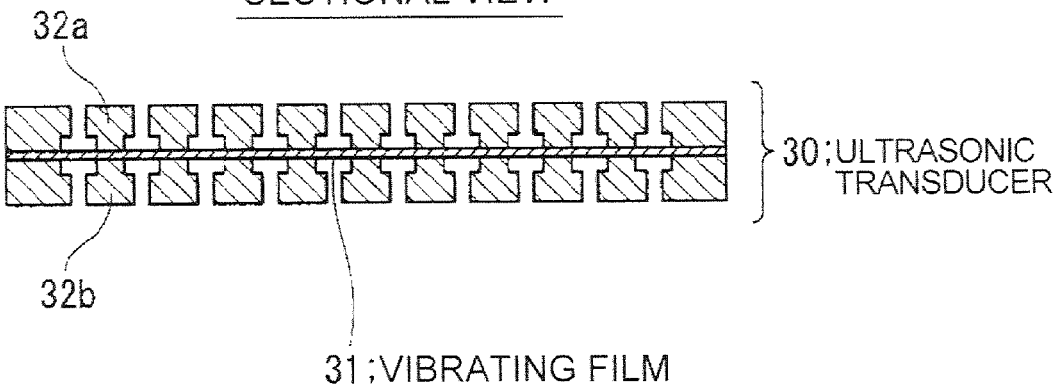

FIG. 6 is a view showing an example of the fixing electrode 32 of a square shape. In FIG. 6, opposite electrode portions 32*a* and 32*b* formed in the fixing electrode 32 are constructed so as to have a groove of a straight line shape.

Figure 7A:
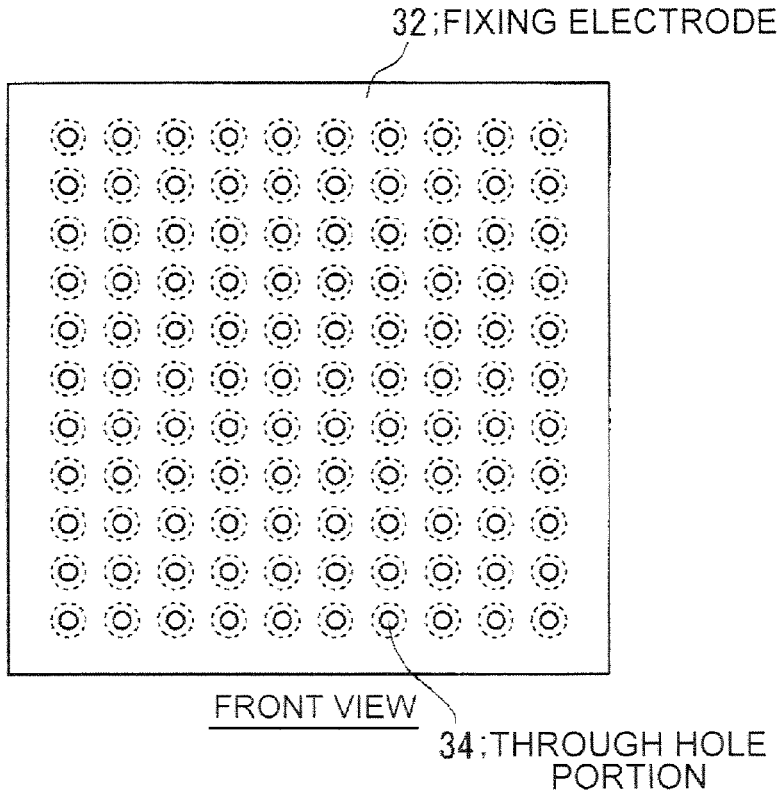
FIGS. 7A and 7B are views showing an example of the fixing electrode having a through hole portion of a round shape.
Figure 7B:
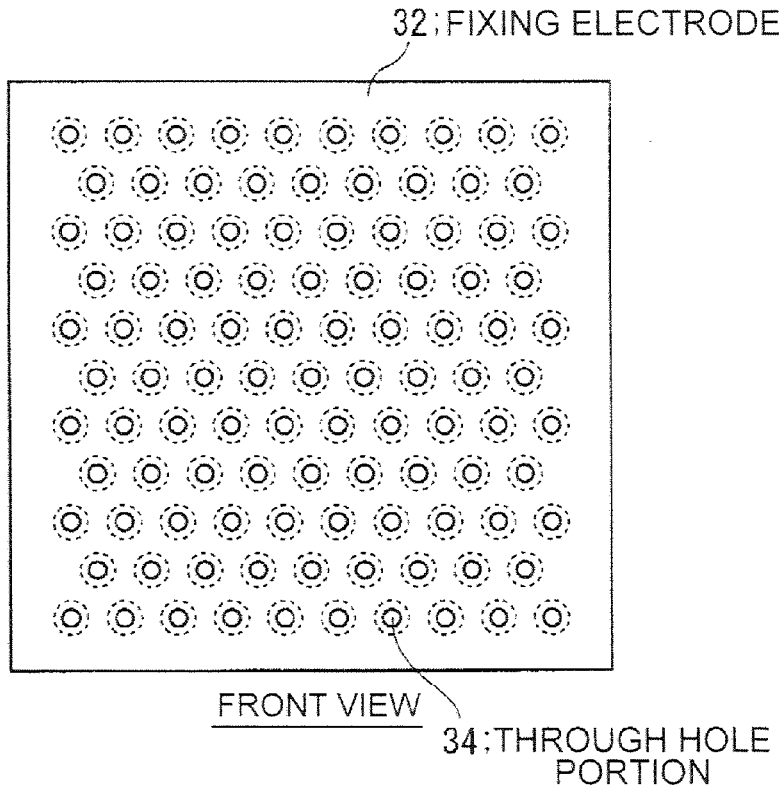

FIG. 7 is a view showing an example of the fixing electrode 32 having a through hole portion 34 of a round shape. FIG. 7(*a*) shows an example in which the through hole portion 34 of the round shape is regularly arranged at a constant interval in the longitudinal and transversal directions. FIG. 7(*b*) shows an example in which the through hole portion 34 is shifted and arranged every column.

FIG. 8 is a view showing an application example of the ultrasonic transducer using the fixing electrode of the square shape. A television system as shown in FIG. 8(*a*) is used as an application example of the ultrasonic transducer using the fixing electrode 32 of the square shape shown in FIGS. 6 and 7 and the ultrasonic speaker constructed by the sound wave reflecting plate of the mode in the present invention.

In the television system 61 shown in FIG. 8(*a*), two ultrasonic transducers 30*a* and 30*b* are mounted. A sound wave reflecting plate 41, integrated into a shape formed by arranging flat plates in a zigzag shape (triangular wave shape) is arranged on the rear faces of the ultrasonic transducers 30*a* and 30*b*. The angle formed by the sound wave radiating faces of the ultrasonic transducers 30*a* and 30*b* and the sound wave reflecting plate 41 is preferably set to 45 degrees as shown in the first example. Sound waves radiated from the rear faces of the ultrasonic transducers 30*a* and 30*b* are changed in the radiating direction by the sound wave reflecting plate 41, and are collected in the central portion of the sound wave reflecting plate 41 so that the sound waves are radiated forwards from an intermediate area of the two ultrasonic transducers 30*a* and 30*b*.

The sound wave can be radiated from a comparatively wide area of the front face of the television system 61 by setting such a construction. Thus, it is possible to provide an ultrasonic speaker for realizing a flat sound pressure distribution in a wide range.

Figure 9:
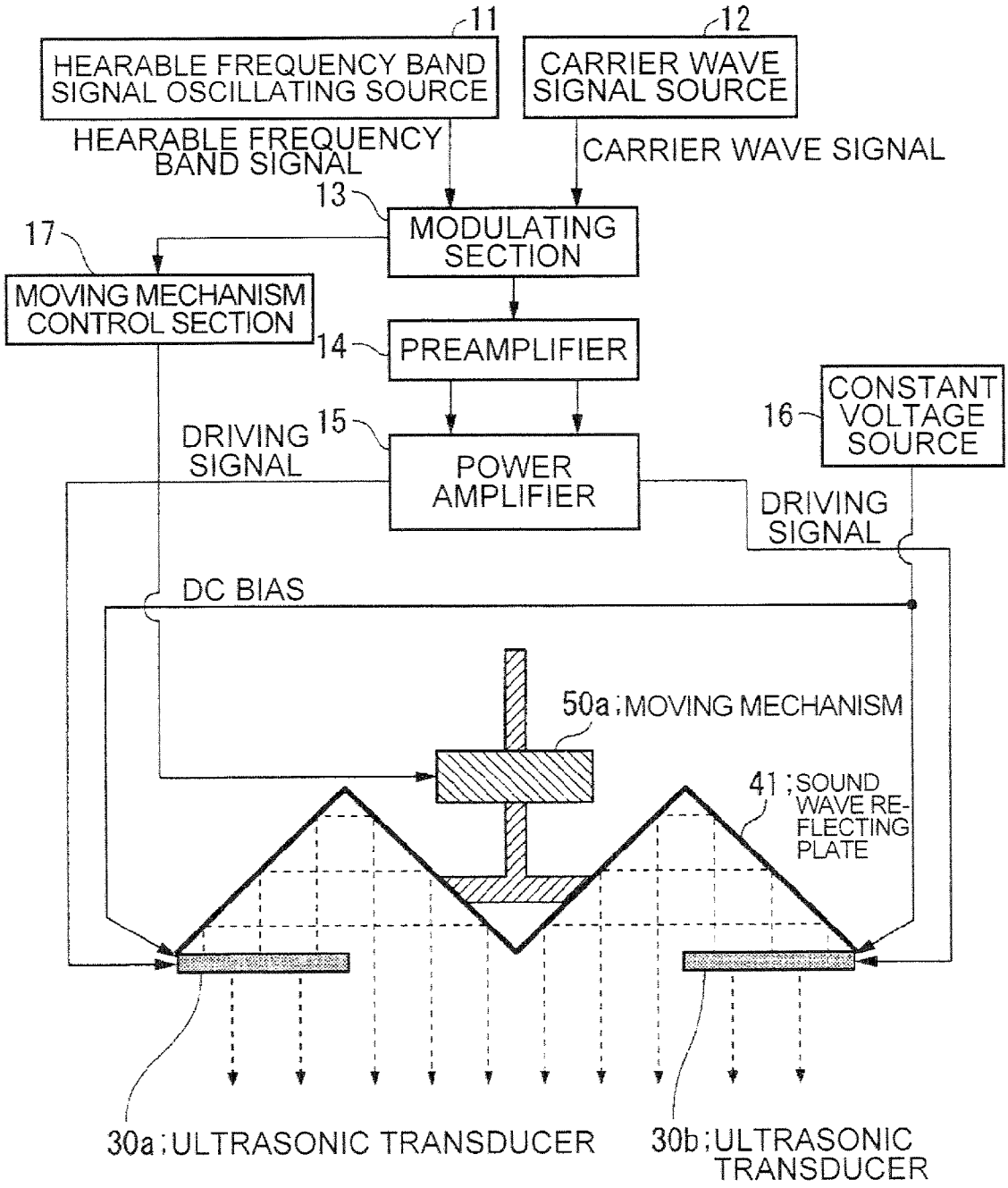
FIG. 9 is a view showing an example of the control circuit of the ultrasonic transducer shown in FIG. 8.
Figures 10A, 10B, 10C:
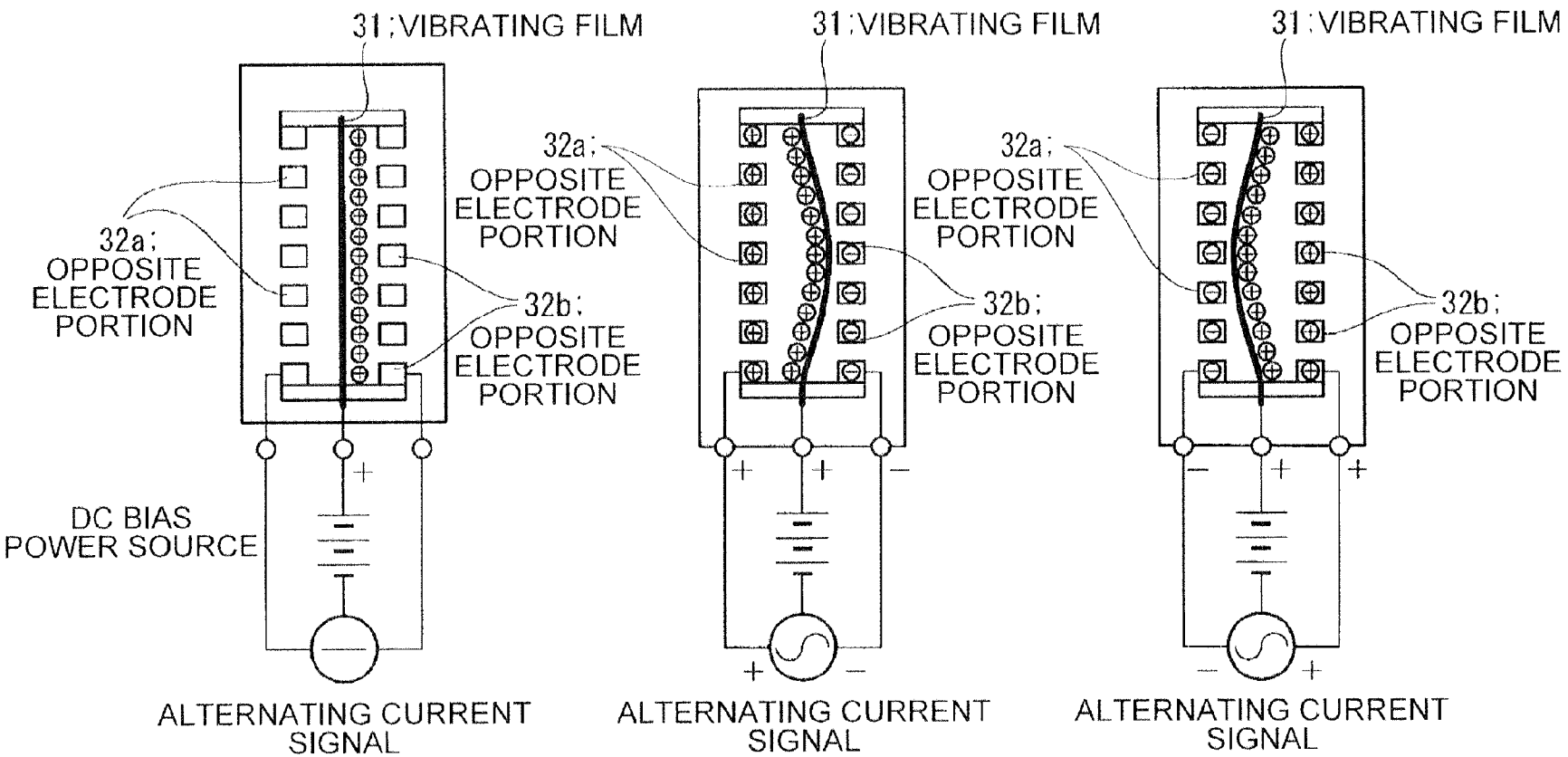
FIGS. 10A-10C are explanatory views of a driving concept of the electrostatic type ultrasonic transducer of the push-pull system.
Figure 11A:
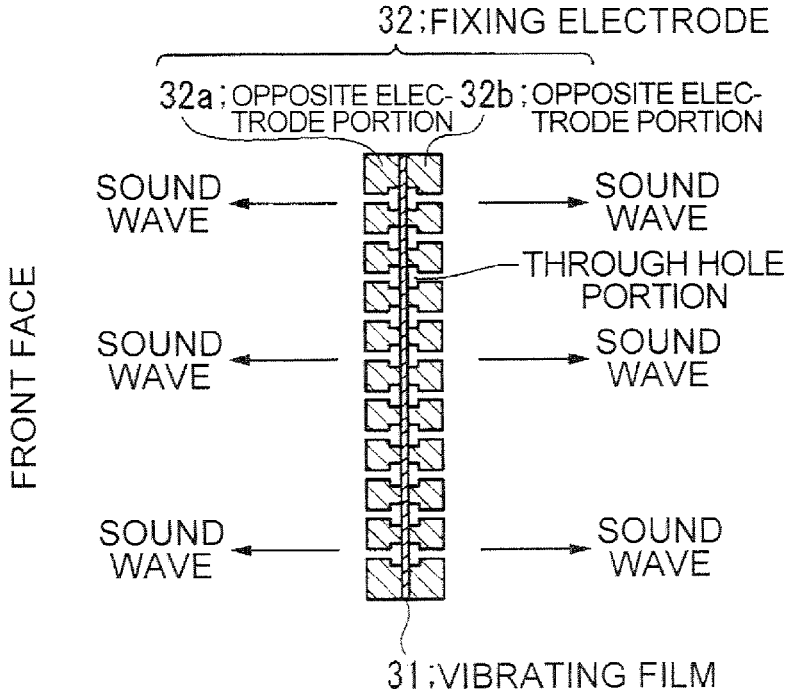
FIGS. 11A and 11B are views showing a using example of the conventional ultrasonic transducer of the push-pull system.
Figure 11B:
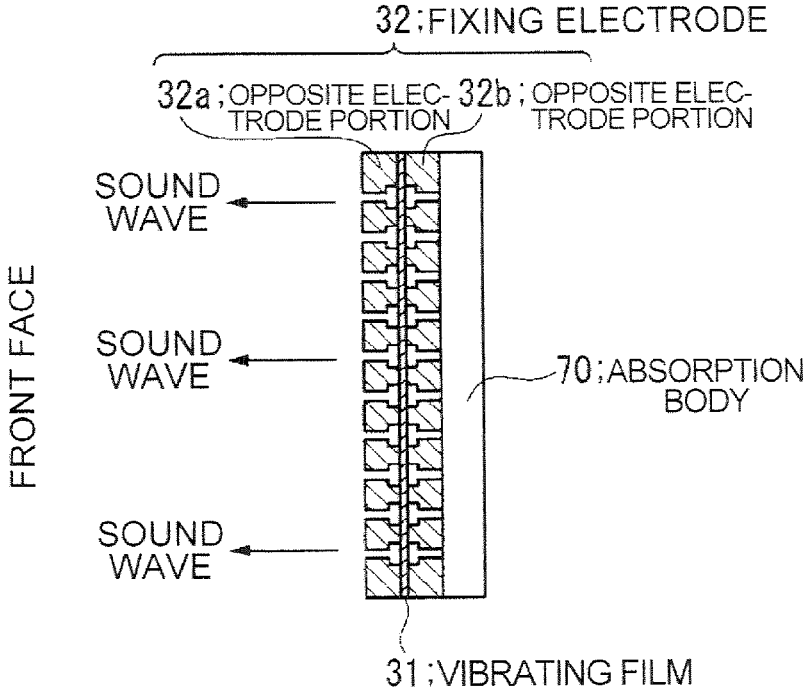
Figure 12:
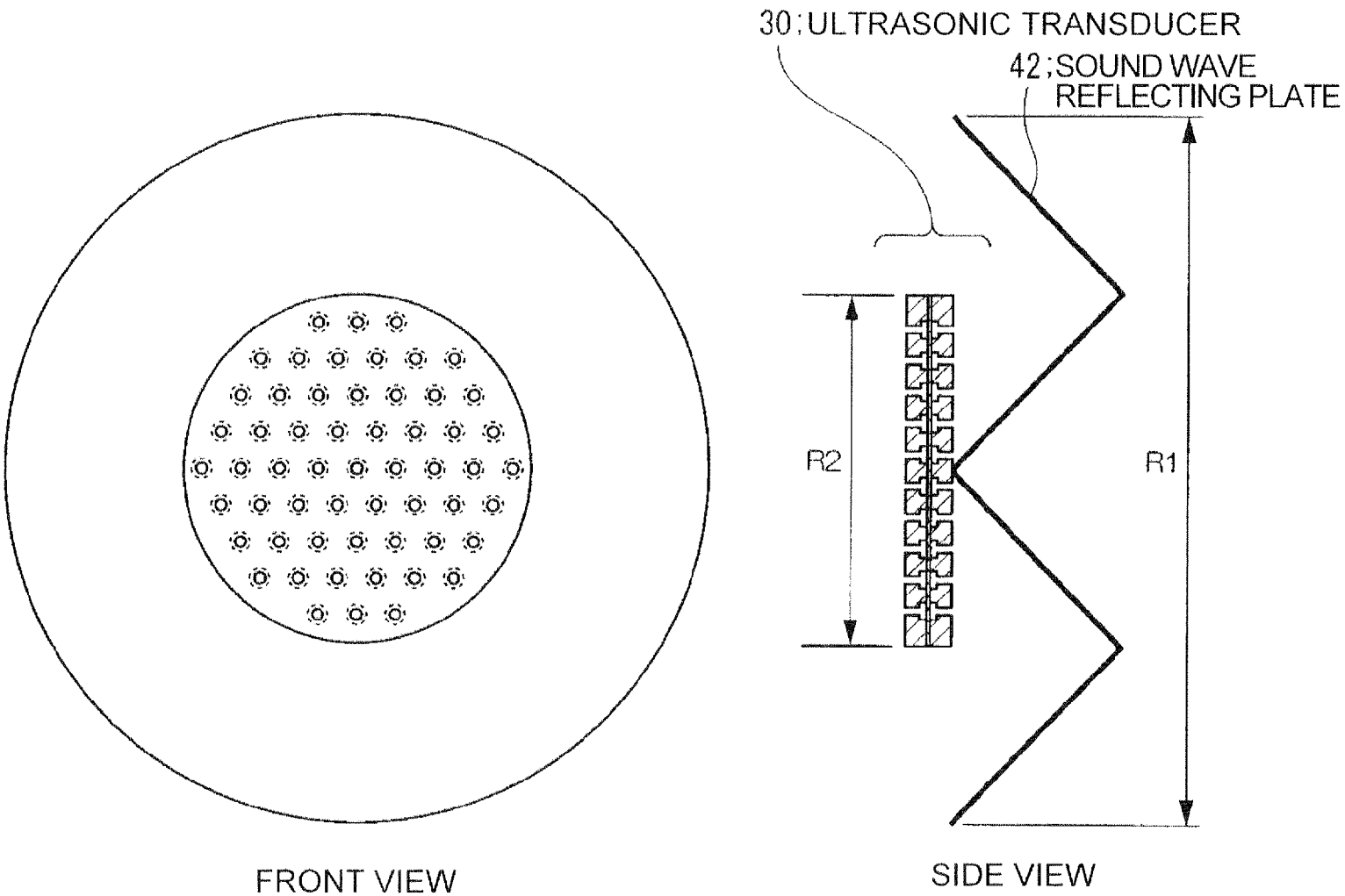
FIG. 12 is a view showing a constructional example of a sound wave reflecting plate and the transducer of the push-pull type.

FIG. 9 is a view showing an example of a control circuit of the ultrasonic transducer shown in FIG. 8. In the example shown in FIG. 9, a moving mechanism 50*a* is arranged with respect to the sound wave reflecting plate 41. Respective functional portions 11 to 17 constituting the control circuit are similar to those shown in FIG. 5, and their explanations are therefore omitted.

In accordance with the construction as shown in FIG. 9, it is possible to prevent a reduction of the sound pressure near the boundary caused by the difference in phase between the sound wave radiated from the front faces of the ultrasonic transducers 30*a* and 30*b* and the sound wave radiated from the rear face and radiated forwards by the sound wave reflecting plate 41. Further, since it is sufficient to arrange one moving mechanism 50*a* with respect to the two ultrasonic transducers 30*a* and 30*b*, it is possible to construct an ultrasonic speaker able to adjust the phase at low cost.

In the drawings, the ultrasonic transducers 30*a* and 30*b* are horizontally arranged, but may be vertically arranged on both sides of the television system (one ultrasonic transducer is arranged on each of the left and right sides), and may be also used for stereo regeneration.

As mentioned above, the embodiments of the present invention have been explained. However, the ultrasonic transducer and the ultrasonic speaker of the present invention are not limited to only the above illustrated examples, but can be variously modified within the scope not departing from the gist of the present invention.

What is claimed is:

1. An ultrasonic speaker comprising:

an electrostatic ultrasonic transducer of a push-pull system including:

a fixing electrode, a circular through hole being arranged in a central portion of said fixing electrode and providing a passage from a front face to a rear face of the ultrasonic transducer, wherein the circular through hole defines an axis of the circular through hole, wherein an outside diameter of said through hole is set to ½ or more of an outside diameter of said fixing electrode;

a sound wave reflecting plate arranged on the rear face of the ultrasonic transducer, wherein an ultrasonic wave radiated from the rear face of ultrasonic transducer is reflected by said sound wave reflecting plate and is radiated to the front face of the ultrasonic transducer through said through hole;

a moving mechanism for moving a position of said sound wave reflecting plate forward and backward along the axis of the circular through hole; and a moving mechanism control means for controlling said moving mechanism to adjust a moving amount of said sound wave reflecting plate from the rear face of said ultrasonic transducer in accordance with a frequency of an ultrasonic carrier wave signal for operating said ultrasonic transducer, wherein said sound wave reflecting plate is arranged on the rear face of said ultrasonic transducer;

said sound wave reflecting plate has a first reflecting face for reflecting the sound wave radiated from the rear face of the ultrasonic transducer in a direction parallel to the sound wave radiating face of the ultrasonic transducer and a central direction of the ultrasonic transducer, and a second reflecting face for reflecting the sound wave radiated from said first reflecting face in the direction of the sound wave radiating face of the ultrasonic transducer, wherein said moving mechanism control means adjusts the moving amount of said sound wave reflecting plate through said moving mechanism such that a difference in carrier path length between the ultrasonic wave directly radiated from the front face of said ultrasonic transducer and the ultrasonic wave radiated from the rear face of said ultrasonic transducer and reflected on said sound wave reflecting plate becomes $n \cdot \lambda + \lambda/2$ (n is an integer) when a wavelength of said ultrasonic carrier wave signal is set to $\lambda$.

2. The ultrasonic speaker according to claim 1, wherein said sound waver reflecting plate is constructed in a middle folding shape in which a top of a hollow conical body having a bottom face portion having a diameter equal to a diameter of said ultrasonic transducer or more and a height of about ½ of a diameter of the bottom face is pushed down until a vicinity of the central bottom face is along a central axis, and is also constructed in a shape in which the bottom face portion is opened, the opened bottom face portion of said sound wave reflecting plate is arranged to be opposed to the rear face of said ultrasonic transducer, and an inner face of a portion not folded in the middle of said sound wave reflecting plate is constructed as a first reflecting face, and an inner face of the portion folded in the middle is constructed as a second reflecting face.

3. An acoustic system comprising:

an electrostatic ultrasonic transducer of a push-pull system including:

a fixing electrode, a circular through hole being arranged in a central portion of said fixing electrode and providing a passage from a front face to a rear face of the ultrasonic transducer, wherein the circular through hole defines an axis of the circular through hole, wherein an outside diameter of said through hole is set to ½ or more of an outside diameter of said fixing electrode;

a sound wave reflecting plate arranged on the rear face of the ultrasonic transducer, wherein an ultrasonic wave radiated from the rear face of ultrasonic transducer is reflected by said sound wave reflecting plate and is radiated to the front face of the ultrasonic transducer through said through hole;

a moving mechanism for moving a position of said sound wave reflecting plate forward and backward along the axis of the circular through hole; and a moving mechanism control means for controlling said moving mechanism to adjust a moving amount of said sound wave reflecting plate from the rear face of said ultrasonic transducer in accordance with a frequency of an ultrasonic carrier wave signal for operating said ultrasonic transducer, wherein said sound wave reflecting plate is arranged on the rear face of said ultrasonic transducer;

said sound wave reflecting plate has a first reflecting face for reflecting the sound wave radiated from the rear face of the ultrasonic transducer in a direction parallel to the sound wave radiating face of the ultrasonic transducer and a central direction of the ultrasonic transducer, and a second reflecting face for reflecting the sound wave radiated from said first reflecting face in the direction of the sound wave radiating face of the ultrasonic transducer, wherein said moving mechanism control means adjusts the moving amount of said sound wave reflecting plate through said moving mechanism such that a difference in carrier path length between the ultrasonic wave directly radiated from the front face of said ultrasonic transducer and the ultrasonic wave radiated from the rear face of said ultrasonic transducer and reflected on said sound wave reflecting plate becomes $n \cdot \lambda + \lambda/2$ (n is an integer) when a wavelength of said ultrasonic carrier wave signal is set to $\lambda$.

4. The ultrasonic speaker according to claim 3, wherein said sound waver reflecting plate is constructed in a middle folding shape in which a top of a hollow conical body having a bottom face portion having a diameter equal to a diameter of said ultrasonic transducer or more and a height of about ½ of a diameter of the bottom face is pushed down until a vicinity of the central bottom face is along a central axis, and is also constructed in a shape in which the bottom face portion is opened, the opened bottom face portion of said sound wave reflecting plate is arranged to be opposed to the rear face of said ultrasonic transducer, and an inner face of a portion not folded in the middle of said sound wave reflecting plate is constructed as a first reflecting face, and an inner face of the portion folded in the middle is constructed as a second reflecting face.

* * * * *